US010235987B1

(12) United States Patent
Valeri et al.

(10) Patent No.: US 10,235,987 B1
(45) Date of Patent: Mar. 19, 2019

(54) METHOD AND APPARATUS THAT CANCEL COMPONENT NOISE USING FEEDFORWARD INFORMATION

(71) Applicant: GM GLOBAL TECHNOLOGY OPERATIONS LLC, Detroit, MI (US)

(72) Inventors: Frank C. Valeri, Novi, MI (US); Michael E. McGuire, Milford, MI (US); Amy K. Luebke, Northville, MI (US); Christopher A. Stirlen, Milford, MI (US); Timothy J. Roggenkamp, Brighton, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 15/903,563

(22) Filed: Feb. 23, 2018

(51) Int. Cl.
*G10K 11/178* (2006.01)

(52) U.S. Cl.
CPC .. *G10K 11/17873* (2018.01); *G10K 11/17823* (2018.01); *G10K 2210/12821* (2013.01); *G10K 2210/12822* (2013.01); *G10K 2210/3027* (2013.01); *G10K 2210/3046* (2013.01)

(58) Field of Classification Search
CPC ..... G10K 11/178; G10K 11/1782; G10K 11/1788; G10K 11/17873; G10K 11/1786; H04R 3/005; H04R 1/1041; F02D 41/222
USPC ..... 375/260, 232; 381/17, 71.1, 71.4, 71.11, 381/71.12, 71.6, 71.8, 94.1; 704/500; 303/9.61; 379/406.06; 398/171; 415/55.1; 455/114.2; 700/298; 706/30; 128/204.21
See application file for complete search history.

(56) References Cited

U.S. PATENT DOCUMENTS 4,213,095 A * 7/1980 Falconer ..... H04L 27/01 333/18
4,710,977 A * 12/1987 Lemelson ..... H04B 10/1125 398/106
5,619,581 A * 4/1997 Ferguson ..... G10K 11/178 381/71.12
5,852,667 A * 12/1998 Pan ..... H04R 1/1008 381/71.1
6,418,227 B1 * 7/2002 Kuo ..... G10K 11/178 381/71.11
6,601,054 B1 * 7/2003 Lo ..... G05B 5/01 706/14
7,031,460 B1 * 4/2006 Zheng ..... G10K 11/17854 379/406.06
7,891,354 B2 * 2/2011 Farbarik ..... A61M 16/0057 128/204.21
8,210,174 B2 * 7/2012 Farbarik ..... A61M 16/00 128/204.18
10,096,314 B2 * 10/2018 Christoph ..... G10K 11/178
2003/0026438 A1 * 2/2003 Ray ..... G10K 11/178 381/71.11
2004/0264706 A1 * 12/2004 Ray ..... G10K 11/178 381/71.11

(Continued)

*Primary Examiner* — Gerald Gauthier

(57) ABSTRACT

A method and apparatus that cancel component noise are provided. The method includes: detecting a trigger to activate component noise cancellation, in response to detecting the trigger, receiving feedforward information from a component, generating noise cancellation information based on the feedforward information, and outputting a noise cancellation sound according to the noise cancellation information.

15 Claims, 3 Drawing Sheets

(56) References Cited

U.S. PATENT DOCUMENTS

2006/0009172 A1* 1/2006 Shamsaifar ..... H03F 1/3223 455/114.2
2007/0064824 A1* 3/2007 Wang ..... H04L 25/03006 375/260
2007/0078568 A1* 4/2007 Donaldson ..... H02M 3/156 700/298
2008/0112569 A1* 5/2008 Asada ..... G10K 11/178 381/71.1
2008/0112570 A1* 5/2008 Asada ..... G10K 11/17855 381/71.6
2008/0137878 A1* 6/2008 Killion ..... G10K 11/178 381/71.6
2009/0080670 A1* 3/2009 Solbeck ..... H04R 25/453 381/71.6
2009/0136052 A1* 5/2009 Hohlfeld ..... G10K 11/178 381/71.1
2010/0195844 A1* 8/2010 Christoph ..... G10K 11/178 381/71.11
2012/0033827 A1* 2/2012 Murata ..... H04R 1/1083 381/94.1
2013/0129106 A1* 5/2013 Sapiejewski ..... H04R 1/105 381/71.6
2013/0156214 A1* 6/2013 Murthy ..... G10K 11/002 381/71.6
2013/0197920 A1* 8/2013 Lesso ..... H04L 25/4902 704/500
2013/0243214 A1* 9/2013 Penketh ..... G10K 11/175 381/71.6
2014/0270225 A1* 9/2014 Gether ..... G10K 11/178 381/71.6
2015/0195646 A1* 7/2015 Kumar ..... G10K 11/178 381/71.8
2015/0274143 A1* 10/2015 Miyazaki ..... B60T 8/348 303/9.61
2015/0373474 A1* 12/2015 Kraft ..... H04R 1/1083 381/17
2016/0125868 A1* 5/2016 Kautz ..... B60L 3/00 381/71.4
2016/0217780 A1* 7/2016 Cagdaser ..... H04R 1/1083
2016/0365083 A1* 12/2016 Bao ..... H04R 1/1016
2017/0061951 A1* 3/2017 Starobin ..... H04R 27/00
2017/0076711 A1* 3/2017 Christoph ..... G10K 11/1788
2017/0076712 A1* 3/2017 Christoph ..... G10K 11/1788
2017/0150256 A1* 5/2017 Christoph ..... H04R 3/005
2017/0200442 A1* 7/2017 Yamabe ..... G10K 11/178
2017/0330551 A1* 11/2017 Zafeiropoulos ..... G10K 11/178
2017/0332163 A1* 11/2017 Yamkovoy ..... H04R 3/007
2018/0047383 A1* 2/2018 Hera ..... G10K 11/178

* cited by examiner

METHOD AND APPARATUS THAT CANCEL COMPONENT NOISE USING FEEDFORWARD INFORMATION

INTRODUCTION

Apparatuses and methods consistent with exemplary embodiments relate to active noise cancellation. More particularly, apparatuses and methods consistent with exemplary embodiments relate to active noise cancellation in vehicle cabins.

SUMMARY

One or more exemplary embodiments provide a method and an apparatus that cancel component noise. More particularly, one or more exemplary embodiments provide a method and an apparatus that cancel vehicle component noise based on feedforward information.

According to an aspect of an exemplary embodiment, a method that cancels component noise based on feedforward information is provided. The method includes: detecting a trigger to activate component noise cancellation, in response to detecting the trigger, receiving feedforward information corresponding to a component, generating noise cancellation information based on the feedforward information, and outputting a noise cancellation sound according to the noise cancellation information.

The method further includes performing a phase alignment on the noise cancellation information based on noise information received by a microphone.

The method further includes determining whether a frequency band of noise is above a predetermined threshold noise level based on the noise information received by the microphone, and adjusting the noise cancellation information to reduce the noise and outputting the adjusted noise cancellation sound if the frequency band of noise is determined to be above the threshold noise level.

The detecting the trigger to activate component noise cancellation may include detecting a fuel level via fuel level sensor and determining that the detected fuel level is above a predetermined threshold fuel level.

The detecting the trigger to activate component noise cancellation may include detecting a heating, ventilation, and air conditioning (HVAC) condition and determining whether the detected HVAC condition triggers receiving the feedforward information.

The detecting the trigger to activate component noise cancellation may include at least one from among detecting a fuel level greater than 50% and outputting a trigger corresponding to a fuel slosh condition, detecting whether HVAC line pressure pulsations is greater than a predetermined number and outputting a trigger corresponding to HVAC compressor growling condition, detecting a caliper acceleration level and outputting a trigger corresponding to a brake noise condition, detecting whether a wiper switch is on and outputting a trigger corresponding to a wiper motor noise condition, detecting current fluctuations and outputting a trigger corresponding to a wiper chatter condition, detecting an electronic parking brake switch is on and outputting a trigger corresponding to electronic parking park noise, detecting wheel speed from a wheel speed sensor and outputting a trigger corresponding to ABS noise, detecting a motor switch is on and outputting a trigger corresponding to a motor whine noise, detecting a filtered peak velocity from a dampener and outputting a trigger corresponding to loose lumber suspension noise, detecting that a pump is on and outputting a trigger corresponding to a pump noise, and detecting a high pressure fuel line pulsation level and an engine condition and outputting a trigger corresponding to a fuel pulsation noise.

The detecting the trigger to activate component noise cancellation may include determining whether current or voltage are above a predetermined threshold current or voltage level.

The feedforward information may include information from a sensor, the information corresponding to at least one from among strain information, pressure pulse information, information on a rate of change of pressure pulses, information on flow rate, information on anti-lock braking system (ABS) vibration, information on caliper acceleration, current information, and voltage information.

The generating noise cancellation information may include generating the noise cancellation information corresponding to a frequency, a phase, and an amplitude of the noise cancellation sound based on the feedforward information.

The outputting the noise cancellation sound may include outputting at least one from among a 30-150 Hz frequency sound to cancel a fuel clunk sound, an 80-400 Hz sound to cancel a fuel pulsation sound, an 80-400 Hz sound to cancel a loose lumber suspension noise, and a 50-300 Hz sound to cancel coolant pump noise, a 200-1000 Hz sound to cancel an A/C growl sound, a 150-500 Hz sound to cancel a brake moan sound, a 30-150 Hz sound to cancel fuel slosh sound, a 150-500 Hz sound to cancel a brake moan sound, an 80-200 Hz sound to cancel windshield wiper motor noise, an 80-500 Hz sound to cancel windshield wiper chatter, an 80-1000 Hz sound to cancel an electric park brake noise, an 80-1000 Hz sound to cancel an ABS brake noise, and a 400-5000 Hz sound to cancel a motor whine.

According to an aspect of another exemplary embodiment, an apparatus that cancels component noise based on feedforward information is provided. The apparatus includes: at least one memory comprising computer executable instructions; and at least one processor configured to read and execute the computer executable instructions. The computer executable instructions causing the at least one processor to detect a trigger to activate component noise cancellation, in response to detecting the trigger, receive feedforward information corresponding to a component, generate noise cancellation information based on the feedforward information, and output a noise cancellation sound according to the noise cancellation information.

The computer executable instructions may cause the at least one processor to perform a phase alignment on the noise cancellation information based on noise information received by a microphone.

The computer executable instructions may cause the at least one processor to determine whether a frequency band of noise is above a predetermined threshold noise level based on the noise information received by the microphone, and adjust the noise cancellation information to reduce the noise and output adjusted noise cancellation sound if the frequency band of noise is determined to be above the threshold noise level.

The computer executable instructions may cause the at least one processor to detect the trigger to activate component noise cancellation by detecting a fuel level via fuel level sensor and determining that the detected fuel level is above a predetermined threshold fuel level.

The computer executable instructions may cause the at least one processor to detect the trigger to activate component noise cancellation by detecting a heating, ventilation, and air conditioning (HVAC) condition and determining whether the detected HVAC condition triggers receiving the feedforward information.

The computer executable instructions cause the at least one processor to output a noise cancellation sound according to the noise cancellation information by outputting at least one from among a 30-150 Hz frequency sound to cancel a fuel clunk sound, an 80-400 Hz sound to cancel a fuel pulsation sound, an 80-400 Hz sound to cancel a loose lumber suspension noise, and a 50-300 Hz sound to cancel coolant pump noise, a 200-1000 Hz sound to cancel an A/C growl sound, a 150-500 Hz sound to cancel a brake moan sound, a 30-150 Hz sound to cancel fuel slosh sound, a 150-500 Hz sound to cancel a brake moan sound, an 80-200 Hz sound to cancel windshield wiper motor noise, an 80-500 Hz sound to cancel windshield wiper chatter (e.g., windshield wiper noise as a wiper moves across a windshield), an 80-1000 Hz sound to cancel an electric park brake noise, an 80-1000 Hz sound to cancel an ABS brake noise, and a 400-5000 Hz sound to cancel a motor whine.

The computer executable instructions may cause the at least one processor to detect the trigger to activate component noise cancellation by determining whether current or voltage are above a predetermined threshold current or voltage level.

The feedforward information may be information from a sensor, the information corresponding to at least one from among strain information, pressure pulse information, information on a rate of change of pressure pulses, information on flow rate, information on anti-lock braking system (ABS) vibration, information on caliper acceleration, current information, and voltage information.

The computer executable instructions may cause the at least one processor to generate noise cancellation information by generating the noise cancellation information corresponding to a frequency, a phase, and an amplitude of the noise cancellation sound based on the feedforward information.

According to an aspect of another exemplary embodiment, a non-transitory computer readable medium comprising computer executable instructions executable by a processor to perform a method that cancels component noise is provided. The method includes: receiving feedforward information from a component, determining whether to generate noise cancellation information based on the feedforward information, in response to determining to generate the noise cancellation information, generating noise cancellation information based on the feedforward information, and outputting a noise cancellation sound based noise cancellation information.

Other objects, advantages and novel features of the exemplary embodiments will become more apparent from the following detailed description of exemplary embodiments and the accompanying drawings.

DETAILED DESCRIPTION OF EXEMPLARY EMBODIMENTS

Figure 1:
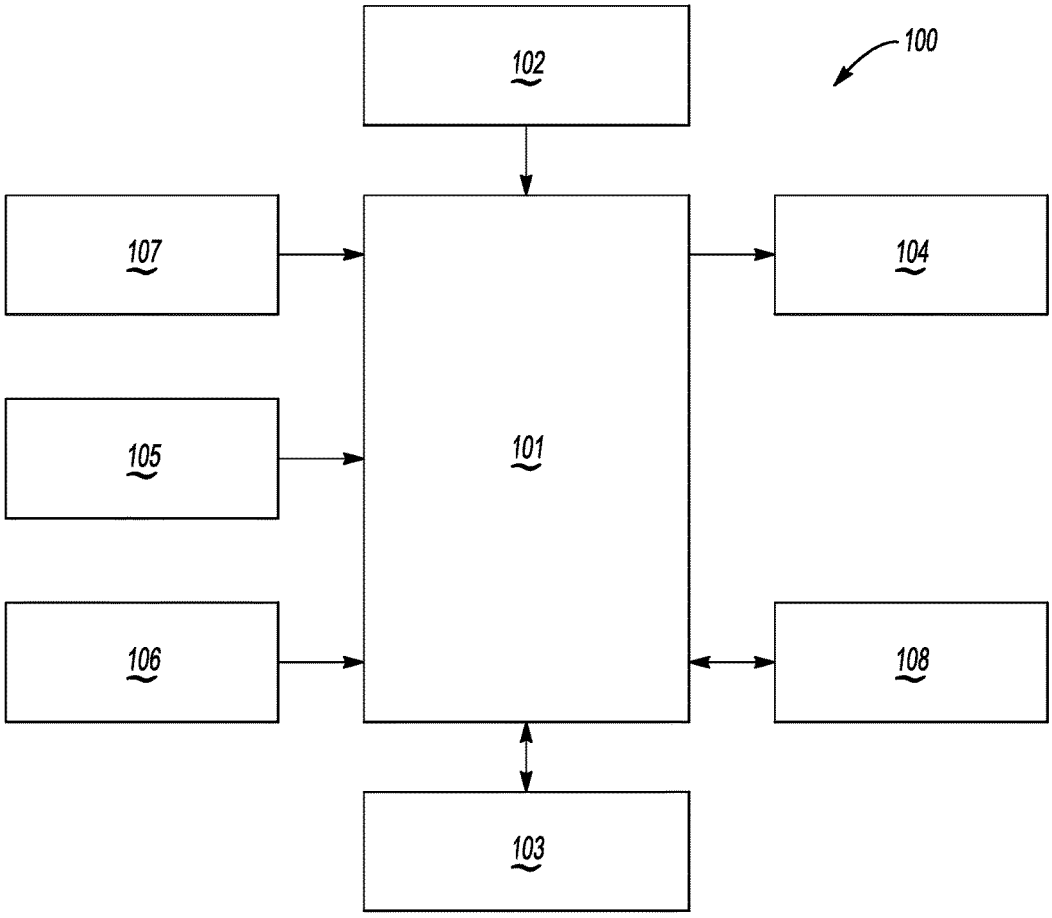
FIG. 1 shows a block diagram of an apparatus that cancels component noise according to an exemplary embodiment.

An apparatus and method that cancel component noise will now be described in detail with reference to FIGS. 1-3 of the accompanying drawings in which like reference numerals refer to like elements throughout.

The following disclosure will enable one skilled in the art to practice the inventive concept. However, the exemplary embodiments disclosed herein are merely exemplary and do not limit the inventive concept to exemplary embodiments described herein. Moreover, descriptions of features or aspects of each exemplary embodiment should typically be considered as available for aspects of other exemplary embodiments.

It is also understood that where it is stated herein that a first element is "connected to," "attached to," "formed on," or "disposed on" a second element, the first element may be connected directly to, formed directly on or disposed directly on the second element or there may be intervening elements between the first element and the second element, unless it is stated that a first element is "directly" connected to, attached to, formed on, or disposed on the second element. In addition, if a first element is configured to "send" or "receive" information from a second element, the first element may send or receive the information directly to or from the second element, send or receive the information via a bus, send or receive the information via a network, or send or receive the information via intermediate elements, unless the first element is indicated to send or receive information "directly" to or from the second element.

Throughout the disclosure, one or more of the elements disclosed may be combined into a single device or into one or more devices. In addition, individual elements may be provided on separate devices.

Noise cancellation technologies have been added to vehicles to vehicles such as cars, trucks, and SUV's to reduce the noise inside of the vehicle cabin. The reduction may reduce the stress or make the ride more pleasurable for occupants of the vehicle cabin. Noise cancellation works by analyzing a waveform or signal of noise usually detected by a microphone and generating a signal that will either phase shift or invert the polarity of the noise waveform or signal. The inverted or phase shifted signal is amplified and a transducer outputs a sound wave directly proportional to the amplitude of the original noise waveform or signal. The output of the transducer reduces the volume of the perceivable noise.

One type noise that is perceivable in the vehicle cabin is noise caused by components or actuated components, e.g., pumps, electric motors, fuel lines, etc. Algorithms that generate the noise cancellation information or noise cancellation signal that will either phase shift or invert the polarity of the waveform or signal of the noise may use feedforward information provided by the component or sensor to better cancel the component noise. For example, the feedforward information may be used to retrieve or generate the noise cancellation information or noise cancellation signal to cancel the noise corresponding to the feedforward information or the component. In another example, the feedforward information may be used to adjust the waveform being output by the noise cancellation device to account for the noise that is going to be generated by a component.

FIG. 1 shows a block diagram of an apparatus that cancels component noise 100 according to an exemplary embodiment. As shown in FIG. 1, the apparatus that cancels component noise 100, according to an exemplary embodiment, includes a controller 101 (i.e., a noise cancellation processor), a power supply 102, a storage 103, an output 104, a component sensor or monitor 105, an input 106, a system trigger monitor 107, and a communication device 108. However, the apparatus that cancels component noise 100 is not limited to the aforementioned configuration and may be configured to include additional elements and/or omit one or more of the aforementioned elements. The apparatus that cancels component noise 100 may be implemented as part of a vehicle, as a standalone component, as a hybrid between an on vehicle and off vehicle device, or in another computing device.

The controller 101 controls the overall operation and function of the apparatus that cancels component noise 100. The controller 101 may control one or more of a storage 103, an output 104, an component sensor or monitor 105, an input 106, a system trigger monitor 107, and a communication device 108 of the apparatus that cancels component noise 100. The controller 101 may include one or more from among a processor, a microprocessor, a central processing unit (CPU), a noise cancellation or audio processor, Application Specific Integrated Circuits (ASICs), Field-Programmable Gate Arrays (FPGAs), state machines, circuitry, and a combination of hardware, software and firmware components.

The controller 101 is configured to send and/or receive information from one or more of the storage 103, the output 104, the component sensor or monitor 105, the input 106, and the communication device 108 of the apparatus that cancels component noise 100. The information may be sent and received via a bus or network, or may be directly read or written to/from one or more of the storage 103, the output 104, the component sensor or monitor 105, the input 106, the system trigger monitor 107, and the communication device 108 of the apparatus that cancels component noise 100. Examples of suitable network connections include a controller area network (CAN), a media oriented system transfer (MOST), a local interconnection network (LIN), a local area network (LAN), A2B Bus, wireless networks such as Bluetooth and 802.11, and other appropriate connections such as Ethernet.

The power supply 102 provides power to one or more of the controller 101, the storage 103, the output 104, the component sensor or monitor 105, the input 106, the system trigger monitor 107, and the communication device 108, of the apparatus that cancels component noise 100. The power supply 102 may include one or more from among a battery, an outlet, a capacitor, a solar energy cell, a generator, a wind energy device, an alternator, etc.

The storage 103 is configured for storing information and retrieving information used by the apparatus that cancels component noise 100. The storage 103 may be controlled by the controller 101 to store and retrieve information received from the component sensor or monitor 105 or the system trigger monitor 107. The information may include feedforward information, noise cancellation information, or noise information. The noise information may be information recorded based on a noise signal detected by a microphone. The feedforward information may be one or more of strain information corresponding to a fuel tank of a strain gauge, pressure pulse information, information on a wiper current, information on a motor current, information on ABS vibration, information on HVAC line pressure pulsation, information on tank strain, information on high pressure fuel line pulsations, information on a velocity signal, information on a manipulated signal combining temperature, flow rate and pressure pulsations, information on a rate of change of pressure pulses, current information, and voltage information. The noise cancellation information may be information corresponding to a frequency, a phase, and an amplitude of the noise cancellation sound based on the feedforward information. The storage 103 may also include the computer instructions configured to be executed by a processor to perform the functions of the apparatus that cancels component noise 100.

The storage 103 may include one or more from among floppy diskettes, optical disks, CD-ROMs (Compact Disc-Read Only Memories), magneto-optical disks, ROMs (Read Only Memories), RAMs (Random Access Memories), EPROMs (Erasable Programmable Read Only Memories), EEPROMs (Electrically Erasable Programmable Read Only Memories), magnetic or optical cards, flash memory, cache memory, and other type of media/machine-readable medium suitable for storing machine-executable instructions.

The output 104 outputs information in one or more forms including: visual, audible and/or haptic form. The output 104 may be controlled by the controller 101 to provide outputs to the user of the apparatus that cancels component noise 100. The output 104 may include one or more from among a speaker, a transducer, a shaker, audio, a display, a centrally-located display, a head up display, a windshield display, a haptic feedback device, a vibration device, a tactile feedback device, a tap-feedback device, a holographic display, an instrument light, an indicator light, etc.

The output 104 includes a speaker, a transducer or a shaker configured to output a sound based on noise cancellation information or a noise cancellation signal. The speaker, the transducer or the shaker may be configured to output a 30-150 Hz frequency sound to cancel a fuel clunk sound, an 80-400 Hz sound to cancel a fuel pulsation sound, an 80-400 Hz sound to cancel a loose lumber suspension noise, and a 50-300 Hz sound to cancel coolant pump noise, a 200-1000 Hz sound to cancel an A/C growl sound, a 150-500 Hz sound to cancel a brake moan sound, a 30-150 Hz sound to cancel fuel slosh sound, a 150-500 Hz sound to cancel a brake moan sound, an 80-200 Hz sound to cancel windshield wiper motor noise, an 80-500 Hz sound to cancel windshield wiper chatter (e.g., windshield wiper noise as a wiper moves across a windshield), an 80-1000 Hz sound to cancel an electric park brake noise, an 80-1000 Hz sound to cancel an ABS brake noise, or a 400-5000 Hz sound to cancel a motor whine.

The output 104 may also include a display configured to output notification including one or more from among an audible notification, a light notification, and a display notification indicating component noise cancellation is active.

The component sensor or monitor 105 may be one or more from among a strain gauge disposed on a component and configured to detect strain on a component, a pressure or flow sensor disposed in a line or pipe and configured to detect pressure or flow rate, a current or voltage sensor that may detect the current or voltage at an electric motor or other device, an accelerometer, a speed or velocity sensor, or a thermometer that detects the temperature or an engine or other component. The strain gauge may be disposed on a fuel tank. The pressure or flow sensor may be disposed in or on a HVAC line or fuel line.

The component sensor or monitor 105 may a detect and/or provide information on a wiper current, a motor current, anti-lock braking system (ABS) vibration, high pressure fuel line pulsations, a caliper acceleration, HVAC line pressure pulsations, a velocity signal, and/or a signal combining temperature, pressure pulsations, and/or flow rate.

The input 106 is configured to provide information and commands to the apparatus that cancels component noise 100. The input 106 may be used to provide user inputs, etc., to the controller 101. The input 106 may include one or more from among a touchscreen, a keyboard, a soft keypad, a button, a motion detector, a voice input detector, a microphone, a camera, a trackpad, a mouse, a touchpad, etc. The input 106 may be configured to receive a user input to acknowledge or dismiss the notification output by the output 104. The input 106 may also be configured to receive a user input to activate or deactivate the apparatus that cancels component noise 100. For example, the setting to turn the system on or off may be selected by an operator via input 106.

The system trigger monitor 107 may include one or more from among a fuel gauge or fuel level sensor configured to detect a fuel level of a fuel tank and provide the fuel level to the controller 101, an HVAC monitor configured to detect HVAC settings or conditions and provide the HVAC settings to the controller 101, a current or voltage sensor that may detect the current or voltage at an electric motor, a pressure sensor that may detect pressure, pressure pulsations, or fluid flow, a switch to detect whether a component is turned on, and a temperature thermometer monitor configured to detect temperature of a component and provide the temperature to the controller 101.

The system trigger monitor 107 may monitor to determine whether fuel level is greater than 50% and output a trigger corresponding to a fuel slosh condition, to determine whether HVAC line pressure pulsations is greater than a predetermined number and output a trigger corresponding to HVAC compressor growling condition, to determine a caliper acceleration level and output a trigger corresponding to a brake noise condition, to determine whether a wiper switch is on and output a trigger corresponding to a wiper motor noise condition, to determine whether current fluctuations are detected and output a trigger corresponding to a wiper chatter condition, determine whether an electronic parking brake switch is on and output a trigger corresponding to electronic parking park noise, determine wheel speed from a wheel speed sensor and output a trigger corresponding to ABS noise, determine whether a motor switch is on and output a trigger corresponding to motor whine noise, determine a filtered peak velocity from a dampener and output a trigger corresponding to loose lumber suspension noise, determine whether a pump is on and output a trigger corresponding to a pump noise such as a coolant pump, and to determine a high pressure fuel line pulsation level and engine condition and output a trigger corresponding to a fuel pulsation noise.

The communication device 108 may be used by apparatus that cancels component noise 100 to communicate with various types of external apparatuses according to various communication methods. The communication device 108 may be used to send/receive information on to/from the controller 101 of the apparatus that cancels component noise 100.

The communication device 108 may include various communication modules such as one or more from among a telematics unit, a broadcast receiving module, a near field communication (NFC) module, a GPS receiver, a wired communication module, or a wireless communication module. The broadcast receiving module may include a terrestrial broadcast receiving module including an antenna to receive a terrestrial broadcast signal, a demodulator, and an equalizer, etc. The NFC module is a module that communicates with an external apparatus located at a nearby distance according to an NFC method. The GPS receiver is a module that receives a GPS signal from a GPS satellite and detects a current location. The wired communication module may be a module that receives information over a wired network such as a local area network, a controller area network (CAN), A2B Bus, or an external network. The wireless communication module is a module that is connected to an external network by using a wireless communication protocol such as IEEE 802.11 protocols, WiMAX, Wi-Fi or IEEE communication protocol and communicates with the external network. The wireless communication module may further include a mobile communication module that accesses a mobile communication network and performs communication according to various mobile communication standards such as $3^{rd}$ generation (3G), $3^{rd}$ generation partnership project (3GPP), long-term evolution (LTE), Bluetooth, EVDO, CDMA, GPRS, EDGE or ZigBee.

According to an exemplary embodiment, the controller 101 of the apparatus that cancels component noise 100 may be configured to detect a trigger to activate component noise cancellation, in response to detecting the trigger, receive feedforward information from a component, generate noise cancellation information based on the feedforward information, and output a noise cancellation sound according to the noise cancellation information.

The controller 101 of the apparatus that cancels component noise 100 may be configured to perform a phase alignment on the noise cancellation information based on noise information received by a microphone.

The controller 101 of the apparatus that cancels component noise 100 may be configured to determine whether noise is above a predetermined threshold noise level based on the noise information received by the microphone, and adjust the noise cancellation information to reduce the noise and output adjusted noise cancellation sound if the noise is determined to be above the threshold noise level.

In addition, the controller 101 of the apparatus that cancels component noise 100 may be configured to detect the trigger to activate component noise cancellation by detecting a fuel level via a fuel level sensor and determining that the detected fuel level is above or below a predetermined threshold fuel level.

The controller 101 of the apparatus that cancels component noise 100 may be configured to detect the trigger to activate component noise cancellation by detecting a heating, ventilation, and air conditioning (HVAC) condition and determining whether the detected HVAC condition triggers receiving the feedforward information.

The controller 101 of the apparatus that cancels component noise 100 may be configured to detect the trigger to activate component noise cancellation by detecting an engine temperature and determining whether the detected engine temperature is above or below a predetermined threshold engine temperature.

According to another exemplary embodiment, the controller 101 may also be configured to detect an input to activate component noise cancellation comprises determining whether one or more from among current or voltage are above or below a predetermined threshold current or voltage level.

According to another exemplary embodiment, the controller 101 may also be configured to detect an input to generate noise cancellation information comprises generating the noise cancellation information corresponding to a frequency, a phase, and/or an amplitude of the noise cancellation sound based on the feedforward information.

Figure 2:
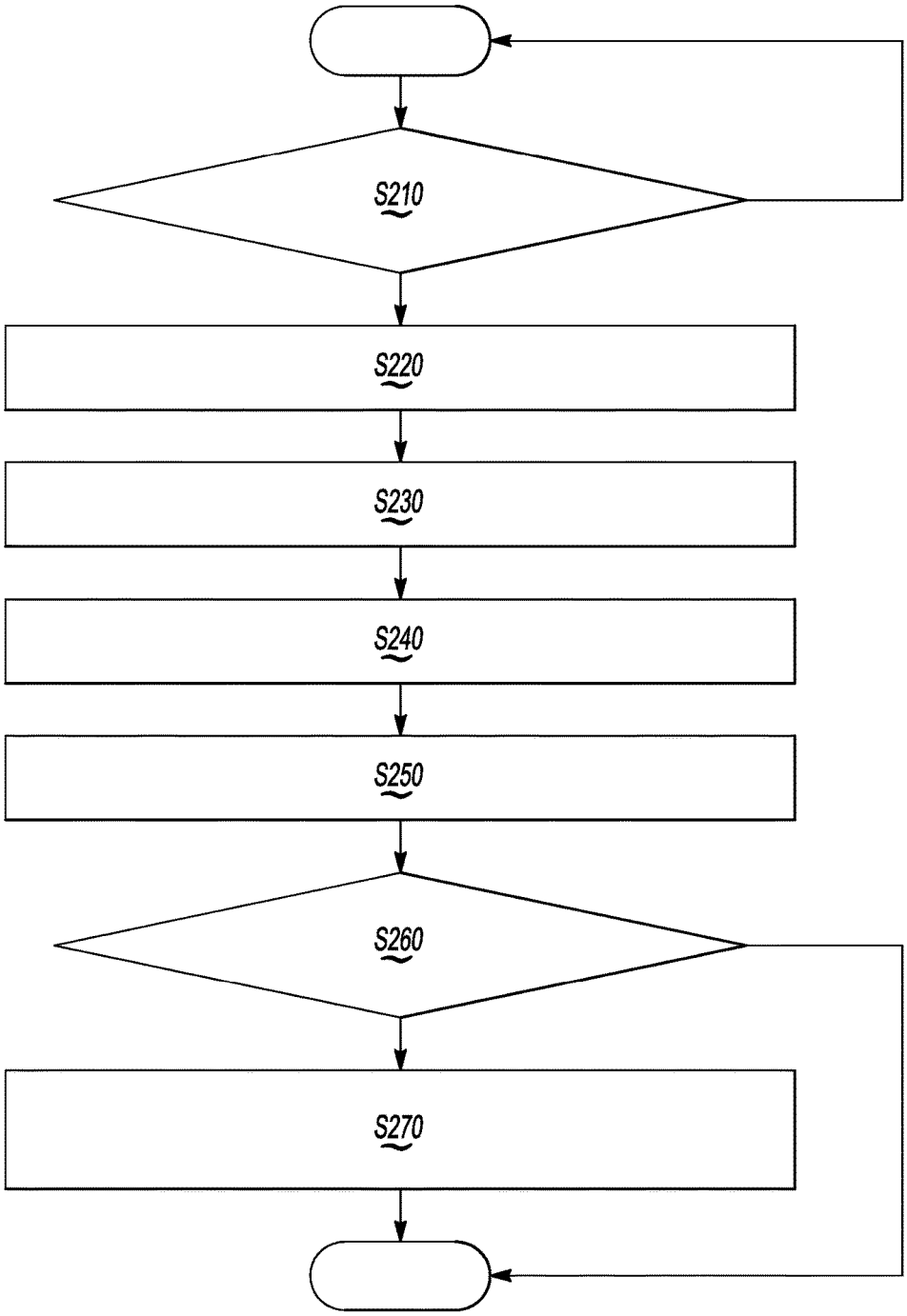
FIG. 2 shows a flowchart for a method that cancels component noise according to an exemplary embodiment.

FIG. 2 shows a flowchart for a method that cancels component noise according to an exemplary embodiment. The method of FIG. 2 may be performed by the apparatus that cancels component noise 100 or may be encoded into a computer readable medium as instructions that are executable by a computer to perform the method.

Referring to FIG. 2, monitoring to determine whether a component noise cancellation trigger is active is performed in operation S210. If the component noise cancellation trigger is active (operation S210—Yes), the process continues to operation S220 to check the feedforward signal or information. If the component noise cancellation trigger is inactive (operation S210—No), the process may end or may continuously check or wait until the component noise cancellation trigger is active.

Examples of noise cancellation triggers may be fuel level setting, an HVAC setting, or an engine temperature setting. In particular, the system may be check the present fuel level to determine if it corresponds to a triggering fuel setting, the present HVAC settings to determine if they correspond to triggering HVAC settings or a present engine temp to determine if it corresponds to the triggering engine temp setting.

In operation S220, the feedforward signal or information corresponding to the component noise is received and may be checked to determine if it meets a predetermined threshold level. For example, information from a strain gauge on a tank shell or HVAC/Coolant pump may be checked to determine if the strain meets a threshold level of strain. In another example, information on a current or voltage from a motor may be checked to determine whether the current or voltage meet a threshold level of current or voltage. In yet another example, information from a pressure sensor or fluid flow sensor may be checked to determine if the pressure or fluid flow meet a threshold level of pressure or fluid flow.

If the feedforward signal or information corresponding to the component noise does meet a predetermined threshold level, monitoring of the feedforward signal or information corresponding to the component noise continues. If the feedforward signal or information corresponding to the component noise meets a predetermined threshold level, noise cancellation information is generated based on the feedforward information in operation S230.

In operation S240, a noise cancellation signal or sound is generated and output based on the noise cancellation information. In operation S250, a phase alignment of the noise cancellation output is performed.

In operation S260, the noise is monitored to determine if it is above a threshold noise level. If the noise is above a threshold noise level (operation S260—Yes), then the noise cancellation information is adjusted to reduce noise and the adjusted noise cancellation sound is output in operation S270. If the noise is below a threshold noise level (operation S260—No), then the process ends.

Figure 3:
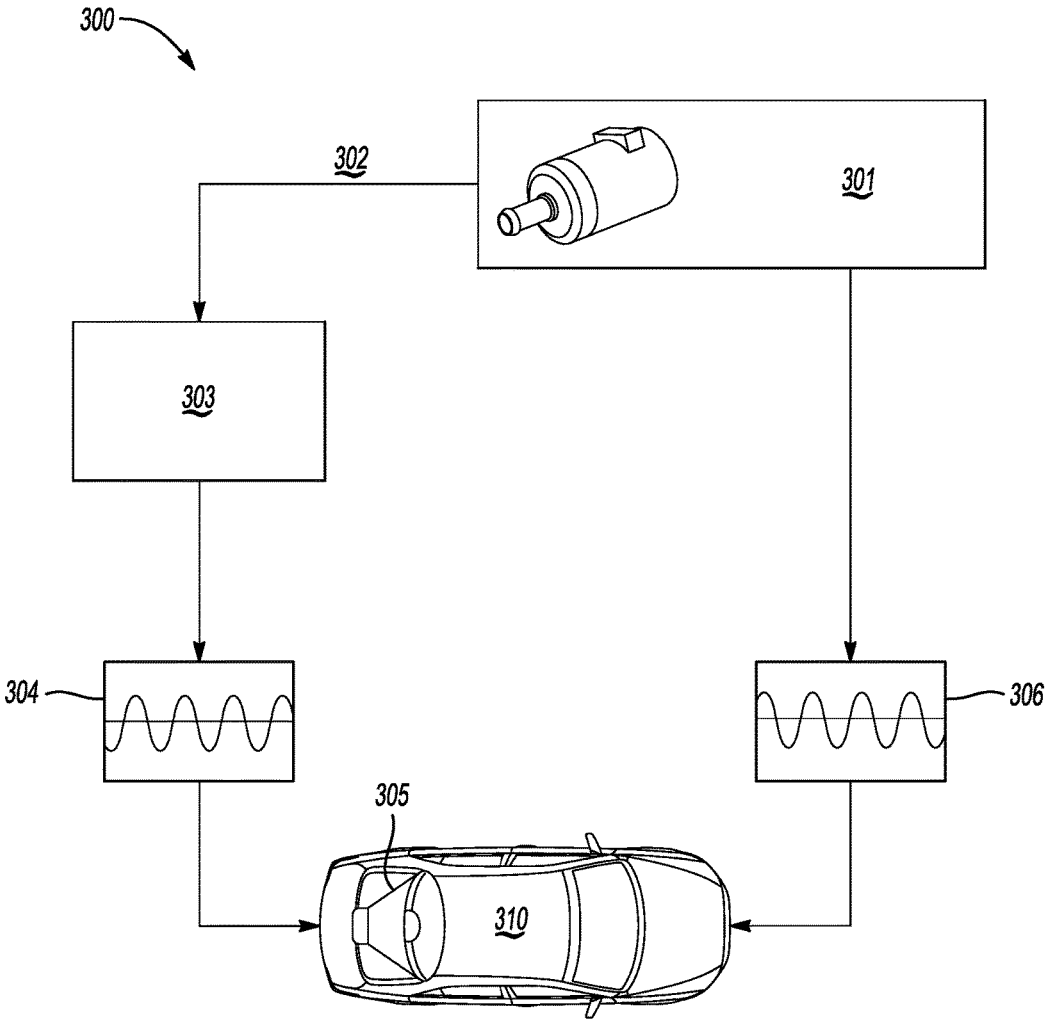
FIG. 3 shows an illustration of component noise cancellation system according to an aspect of an exemplary embodiment.

FIG. 3 shows an illustration of component noise cancellation system 300 according to an aspect of an exemplary embodiment.

Referring to FIG. 3, a component 301 generates noise (i.e., component noise 306) when the component is operating. An example of a component may be an electric motor, a pump, or a fluid line. The component may be present in a vehicle 310 and the component noise may be heard by a passenger in the cabin of the vehicle 310.

A feedforward signal 302 (e.g., feedforward information) from the component 301 may be provided to the noise cancellation device 303 (e.g., processor) and used to adjust a noise cancellation information 304 or signal output by the noise cancellation device 303. The noise cancellation information 304 or signal may cause the output or speaker 305 to produce an active noise cancellation sound to cancel out or reduce the component noise 306 so that the component noise 306 is reduced or imperceptible to a passenger in the cabin of vehicle 310.

The processes, methods, or algorithms disclosed herein can be deliverable to/implemented by a processing device, controller, or computer, which can include any existing programmable electronic control device or dedicated electronic control device. Similarly, the processes, methods, or algorithms can be stored as data and instructions executable by a controller or computer in many forms including, but not limited to, information permanently stored on non-writable storage media such as ROM devices and information alterably stored on writeable storage media such as floppy disks, magnetic tapes, CDs, RAM devices, and other magnetic and optical media. The processes, methods, or algorithms can also be implemented in a software executable object. Alternatively, the processes, methods, or algorithms can be embodied in whole or in part using suitable hardware components, such as Application Specific Integrated Circuits (ASICs), Field-Programmable Gate Arrays (FPGAs), state machines, controllers or other hardware components or devices, or a combination of hardware, software and firmware components.

One or more exemplary embodiments have been described above with reference to the drawings. The exemplary embodiments described above should be considered in a descriptive sense only and not for purposes of limitation. Moreover, the exemplary embodiments may be modified without departing from the spirit and scope of the inventive concept, which is defined by the following claims.

What is claimed is:

1. A method that cancels component noise based on feedforward information, the method comprising:

detecting a trigger to activate component noise cancellation;

in response to detecting the trigger, receiving feedforward information corresponding to a component from a sensor;

generating noise cancellation information based on the feedforward information; and outputting, by a transducer, a noise cancellation sound according to the noise cancellation information, wherein the feedforward information comprises information from a sensor, the information corresponding to at least one from among strain information, pressure pulse information, information on a rate of change of pressure pulses, information on flow rate, information on anti-lock braking system (ABS) vibration, information on caliper acceleration, electric current information, and voltage information, and wherein the trigger comprises at least one from among a heating, ventilation, and air conditioning (HVAC) condition, a fuel level at a predetermined level detected by a fuel level sensor, a current or voltage being above a predetermined threshold current or voltage, HVAC line pressure pulsations greater than a predetermined number corresponding to an HVAC compressor growling condition, a caliper acceleration level corresponding to a brake noise condition, a wiper switch being on indicating a wiper motor noise condition, current fluctuations indicating a wiper chatter condition, an electronic parking brake switch being on indicating electronic parking park noise, a wheel speed from a wheel speed sensor indicating ABS noise, a motor switch being on indicating a motor whine noise, a filtered peak velocity from a dampener indicating loose lumber suspension noise, a pump being on indicating a pump noise, a high pressure fuel line pulsation level and an engine condition indicating a fuel pulsation noise.

2. The method of claim 1, further comprising performing a phase alignment on the noise cancellation information based on noise information received by a microphone.

3. The method of claim 2, further comprising:

determining whether a frequency band of noise is above a predetermined threshold noise level based on the noise information received by the microphone; and adjusting the noise cancellation information to reduce the noise and outputting the adjusted noise cancellation sound if the frequency band of noise is determined to be above the threshold noise level.

4. The method of claim 1, wherein the detecting the trigger to activate component noise cancellation further comprises detecting the fuel level via a fuel level sensor and determining that the detected fuel level is above a predetermined threshold fuel level.

5. The method of claim 1, wherein the detecting the trigger to activate component noise cancellation further comprises detecting the heating, ventilation, and air conditioning (HVAC) condition and determining whether the detected HVAC condition triggers receiving the feedforward information.

6. The method of claim 1, wherein the generating noise cancellation information comprises generating the noise cancellation information corresponding to a frequency, a phase, and an amplitude of the noise cancellation sound based on the feedforward information.

7. The method of claim 1, wherein the outputting the noise cancellation sound comprises outputting at least one from among a 30-150 Hz frequency sound to cancel a fuel clunk sound, an 80-400 Hz sound to cancel a fuel pulsation sound, an 80-400 Hz sound to cancel a loose lumber suspension noise, and a 50-300 Hz sound to cancel coolant pump noise, a 200-1000 Hz sound to cancel an A/C growl sound, a 150-500 Hz sound to cancel a brake moan sound, a 30-150 Hz sound to cancel fuel slosh sound, a 150-500 Hz sound to cancel a brake moan sound, an 80-200 Hz sound to cancel windshield wiper motor noise, an 80-500 Hz sound to cancel windshield wiper chatter, an 80-1000 Hz sound to cancel an electric park brake noise, an 80-1000 Hz sound to cancel an ABS brake noise, and a 400-5000 Hz sound to cancel a motor whine.

8. An apparatus that cancels component noise based on feedforward information, the apparatus comprising:

at least one memory comprising computer executable instructions; and at least one processor configured to read and execute the computer executable instructions, the computer executable instructions causing the at least one processor to:

detect a trigger to activate component noise cancellation;

in response to detecting the trigger, receive feedforward information corresponding to a component from a sensor;

generate noise cancellation information based on the feedforward information; and output, by a transducer, a noise cancellation sound according to the noise cancellation information, wherein the feedforward information comprises information from a sensor, the information corresponding to at least one from among strain information, pressure pulse information, information on a rate of change of pressure pulses, information on flow rate, information on anti-lock braking system (ABS) vibration, information on caliper acceleration, electric current information, and voltage information, and wherein the trigger comprises at least one from among a heating, ventilation, and air conditioning (HVAC) condition, a predetermined fuel level being detected by the fuel level sensor, and a current or voltage being above a predetermined threshold current or voltage level.

9. The apparatus of claim 8, wherein the computer executable instructions cause the at least one processor to perform a phase alignment on the noise cancellation information based on noise information received by a microphone.

10. The apparatus of claim 8, wherein the computer executable instructions cause the at least one processor to determine whether a frequency band of noise is above a predetermined threshold noise level based on the noise information received by the microphone, and adjust the noise cancellation information to reduce the noise and output adjusted noise cancellation sound if the frequency band of noise is determined to be above the threshold noise level.

11. The apparatus of claim 8, wherein the computer executable instructions cause the at least one processor to detect the trigger to activate component noise cancellation by detecting the fuel level via the fuel level sensor and determining that the detected fuel level is above a predetermined threshold fuel level.

12. The apparatus of claim 8, wherein the computer executable instructions cause the at least one processor to detect the trigger to activate component noise cancellation by detecting the heating, ventilation, and air conditioning (HVAC) condition and determining whether the detected HVAC condition triggers receiving the feedforward information.

13. The apparatus of claim 8, wherein the computer executable instructions cause the at least one processor to output a noise cancellation sound according to the noise cancellation information by outputting at least one from among a 30-150 Hz frequency sound to cancel a fuel clunk sound, an 80-400 Hz sound to cancel a fuel pulsation sound, an 80-400 Hz sound to cancel a loose lumber suspension noise, and a 50-300 Hz sound to cancel coolant pump noise, a 200-1000 Hz sound to cancel an A/C growl sound, a 150-500 Hz sound to cancel a brake moan sound, a 30-150 Hz sound to cancel fuel slosh sound, a 150-500 Hz sound to cancel a brake moan sound, an 80-200 Hz sound to cancel windshield wiper motor noise, an 80-500 Hz sound to cancel windshield wiper chatter (e.g., windshield wiper noise as a wiper moves across a windshield), an 80-1000 Hz sound to cancel an electric park brake noise, an 80-1000 Hz sound to cancel an ABS brake noise, and a 400-5000 Hz sound to cancel a motor whine.

14. The apparatus of claim 8, wherein the computer executable instructions cause the at least one processor to generate noise cancellation information by generating the noise cancellation information corresponding to a frequency, a phase, and an amplitude of the noise cancellation sound based on the feedforward information.

15. A non-transitory computer readable medium comprising computer executable instructions executable by a processor to perform a method that cancels component noise, the method comprising:

receiving feedforward information corresponding to a component from a sensor;

determining whether to generate noise cancellation information based on the feedforward information;

in response to determining to generate the noise cancellation information, generating noise cancellation information based on the feedforward information; and outputting, by a transducer, a noise cancellation sound based noise cancellation information, wherein the feedforward information comprises information from a sensor, the information corresponding to at least one from among strain information, pressure pulse information, information on a rate of change of pressure pulses, information on flow rate, information on anti-lock braking system (ABS) vibration, information on caliper acceleration, electric current information, and voltage information, and wherein the trigger comprises at least one from among a heating, ventilation, and air conditioning (HVAC) condition, a predetermined fuel level being detected by fuel level sensor, and a current or voltage being above a predetermined threshold current or voltage level.

* * * * *